United States Patent [19]

Worcester et al.

[11] Patent Number: 5,013,357

[45] Date of Patent: May 7, 1991

[54] DIRECT PRODUCTION OF NIOBIUM TITANIUM ALLOY DURING NIOBIUM REDUCTION

[75] Inventors: Samuel A. Worcester; Patti L. Case, both of Ogden, Utah

[73] Assignee: Westinghouse Electric Corp., Pittsburgh, Pa.

[21] Appl. No.: 426,840

[22] Filed: Oct. 26, 1989

[51] Int. Cl.[5] ..... C22B 34/00

[52] U.S. Cl. ..... 75/622

[58] Field of Search ..... 75/84 R; 420/425

[56] References Cited

U.S. PATENT DOCUMENTS

| | | | |
|---|---|---|---|
| 2,789,896 | 4/1957 | Coffer | 75/27 |
| 2,937,939 | 5/1960 | Wilhelm | 75/84 R |
| 3,132,024 | 5/1964 | Matricardi | 75/84 R |
| 3,167,692 | 1/1965 | Matthias | 317/158 |
| 3,268,373 | 8/1966 | Reynolds | 148/32.5 |
| 3,372,022 | 3/1968 | Guntermann | 75/27 |
| 4,169,722 | 10/1979 | Fletcher | 75/10 R |
| 4,419,127 | 12/1983 | Tanson | 75/10 R |
| 4,504,310 | 3/1985 | Boulier | 75/27 |

*Primary Examiner*—Peter D. Rosenberg
*Attorney, Agent, or Firm*—Z. L. Dermer

[57] ABSTRACT

A superconductive alloy of titanium and niobium is formed during reduction of niobium pentoxide by adding an effective quantity of titanium metal and/or titanium oxide to a reduction mixture of aluminum and niobium pentoxide. The resulting mixture is reacted to form the desired niobium titanium alloy below an aluminum oxide or aluminum oxide-titanium oxide slag. The slag is easily separated from the alloy.

16 Claims, 2 Drawing Sheets

DIRECT PRODUCTION OF NIOBIUM TITANIUM ALLOY DURING NIOBIUM REDUCTION

BACKGROUND OF THE INVENTION

1. Field of the Invention

The invention is in the field of production of niobium alloys, particularly titanium niobium alloys.

2. Description of the Prior Art

The alloying of other metals with niobium (formerly called columbium) is a well developed art and includes processes for alloying titanium with niobium in the production of electrical superconductors. Examples of the latter technology are found in U.S. Pat. Nos. 3,167,692 and 3,268,373.

Processes have been proposed for reducing niobium oxides by mixing such an oxide with a metallic reducing agent, see U.S. Pat. Nos. 2,789,896 and 4,419,127.

The use of aluminum in such processes for creating a thermite reaction to supply the necessary heat is common practice, see U.S. Pat. Nos. 3,372,022; 4,164,417; 4,169,722; and 4,504,310, and Japanese Patent No. 47-22313.

The current, commercially accepted practice of producing titanium niobium alloys, particularly as superconductors, is to reduce niobium pentoxide ($Nb_2O_5$) with excess aluminum and a fluxing agent, such as barium oxide, in a thermite reaction to yield niobium metal and an $Al_2O_3$/BaO slag. The niobium metal is separated from the slag and purified by electron beam melting and is then powdered (which is done by the relatively expensive process of hydriding the metal, crushing the hydride, and then dehydriding the powder) and mixed with titanium powder (powdering of alloy constituents, although difficult, has been necessary to minimize phase segregation and achieve sufficient homogenity). The mixture is arc melted to provide the desired alloy and is cast into ingots of the alloy.

SUMMARY OF THE INVENTION

In accordance with the present invention, we have found that a desirable low melting point (approximately 2000° C.), titanium-niobium alloy most suitable for a superconductor can be produced directly in the molten state by a preignition addition of titanium and/or titanium dioxide to a mixture of $Nb_2O_5$ and aluminum. This is a considerable improvement over current practice as described above. A flux is not normally necessary (but can be used), and the alloy and the $Al_2O_3$ slag (possibly containing a small amount of $TiO_2$) can be cleanly separated. The slag melts at 2015° C. or less, and collects on top of the molten mass.

Excess aluminum (more than required to react with all of the oxygen present to reduce all the $Nb_2O_5$ to Nb metal, and possibly to also reduce titanium dioxide to metal) can be used when an electron beam (EB) melting step is used after formation of the alloy, as any aluminum in the product alloy will be removed during EB melting.

Alternately, an essentially aluminum-free alloy can be made by using less aluminum (less than required to react with all of the oxygen present). If enough titanium metal is used in the mixture, part of the $Nb_2O_5$ can be reduced by titanium and the remainder reduced by aluminum. The titanium can also be introduced as titanium dioxide and the aluminum used to reduce all of the niobium oxide and part, but not all, of the titanium dioxide. An $Al_2O_3/TiO_2$ slag is formed when such lesser amounts of aluminum is used.

External heating (preferably by preheating) may be used to raise the total energy balance up to the proper point for the desired alloy to form. A powerful oxidizer, such as sodium chlorate or barium peroxide (as is commonly used to produce ferroniobium), can also be used to add energy. Preheating is preferred as oxidizers are generally either expensive, or produce gaseous byproducts, or both.

Generally, the use of apropriate amounts of titanium dioxide and extra aluminum to reduce the titanium dioxide (the amount that must be added more than that required to reduce the niobium oxide) is cheaper than the use of the appropriate amount of titanium metal and are thus preferred.

DETAILED DESCRIPTION OF PREFERRED EMBODIMENTS

Figure 1:
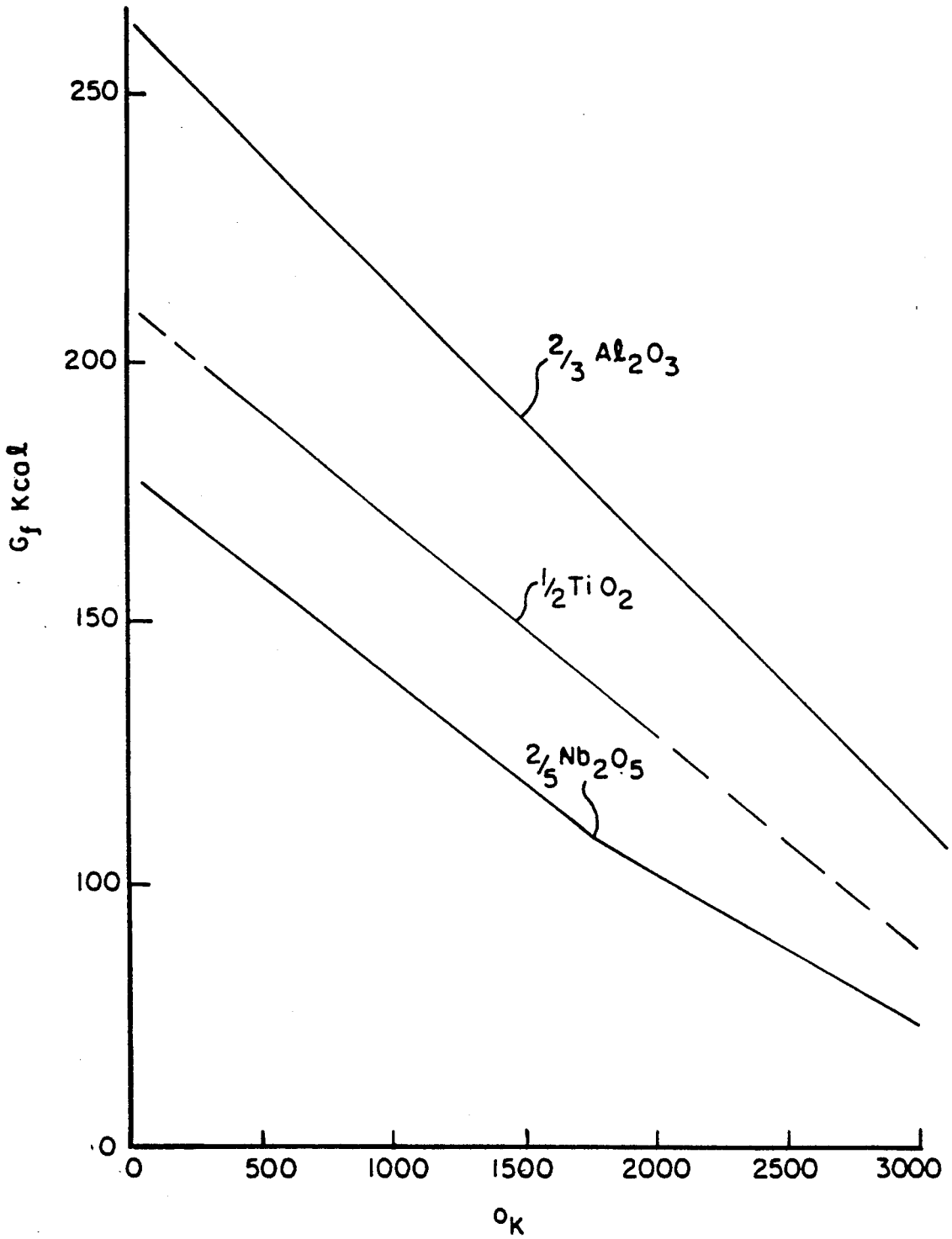
FIG. 1 shows thermodynamic characteristics of the $Al_2O_3$, $TiO_2$ and $Nb_2O_5$ in the 0°-3000° K. range.

The graphs of FIG. 1 summarize the free energies of the system of the oxides in the 0°-3000° K. range.

Figure 2:
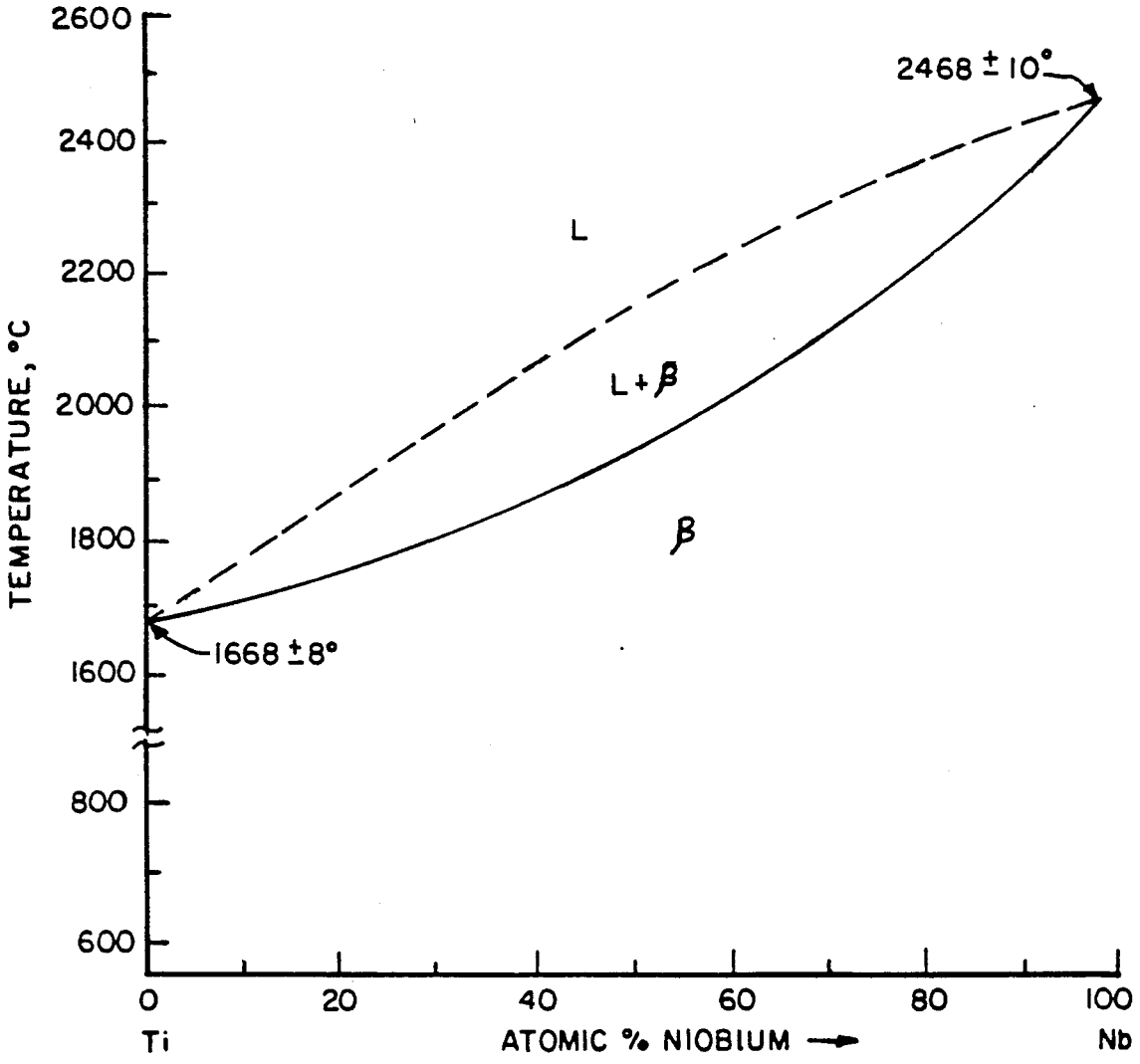
FIG. 2 is a titanium-niobium phase diagram.

FIG. 1 shows the Gibbs free energies for 2/5 $Nb_2O_5$, $TiO_2$, $\frac{2}{3}$ $Al_2O_3$ and 2 TiO as functions of temperature. The compounds are all "normalized" to the same oxygen content for the temperatures of interest (1500°to 2500° C.). It is clear that both aluminum and titanium can theoretically reduce 2/5 $Nb_2O_5$ to the metal, forming $Al_2O_3$ or $TiO_2$. The reaction with aluminum would be more exothermic, for example at 2000° K. the $G_f$ between 2/5 $Nb_2O_5$ and $\frac{2}{3}$ $Al_2O_3$ is approximately 75 Kcal, while between 2/5 $Nb_2O_5$ and $TiO_2$ it is about 25 Kcal (at this temperature both $TiO_2$ and $Nb_2O_5$ are molten), and a mixture of 60% Nb, 40% (molar) Ti is also molten. (Pure Nb would not be molten. It melts at 2750° C.) The enthalpy required to melt a 60% Nb, 40% Ti mixture is about (0.6)(8 Kcal)+(0.4)(6 Kcal)=7.2 Kcal (see FIG. 2). The heat required to melt any $TiO_2$ slag formed is about 12 Kcal/mole ($H_g$ for $Al_2O_3$ is 26 Kcal/mole). The net energy balances are favorable for formation of all molten reaction products (all the $TiO_2$-/$Al_2O_3$ mixtures are molten above 2015° C., see FIG. 4.) For example, if a mixture of (molar basis) 0.31 Al+2.21 T.+0.4 $Nb_2O_5$ is reacted at 2100° K. to form 0.8 Nb+1.44 Ti+0.77 $TiO_2$+0.15 $Al_2O_3$, the energy balance is favorable for formation of molten reaction products.

$$G = \underset{Nb_2O_5}{(.4)(250\ \text{Kcal})} - \underset{TiO_2}{(.77)(125\ \text{Kcal})} - \underset{Al_2O_3}{(.15)(240\ \text{Kcal})} = -36\ \text{Kcal}$$

$$H\ \text{melting} = \underset{TiO_2}{(.77)(11.4)} + \underset{Al_2O_3}{(0.15)(26.0)} + \underset{Nb}{(.8)(6.4)} + \underset{Ti}{(1.44)(4.5)} = 24\ \text{Kcal}$$

Thus, as indicated, aluminum will reduce $Nb_2O_5$ and also TiO2 and Ti will reduce $Nb_2O_5$, and thus in a system of Al, Ti, and $Nb_2O_5$ in which there is slightly less than enough Al to react with all of the oxygen, a niobium-titanium alloy will be formed along with an $Al_2O_3$ slab containing a small amount of TiO2. Stoichiometrically, to use titanium metal and do all reduction with aluminum and make a 51 niobium-49 titanium alloy:

$$3Nb_2O_5+11.14Ti+10Al \quad 6Nb+11.14Ti+5Al_2O_3$$

Similarly, to make the same alloy with a titanium metal and titanium dioxide mixture and stoichiometric aluminum (such that if it were perfectly homogenous, there would be no aluminium in the metal and no $TiO_2$ in the slag, the reaction could be:

$$3Nb_2O_5+8.14Ti+3TiO_2+14Al \quad 6Nb+11.14Ti+7Al_2O_3$$

Further, the need to powder titanium metal can also be eliminated (in all cases, the invention eliminates the need to powder niobium metal) and instead use relatively cheap $TiO_2$ as the source for all of the titanium in the same alloy using the following:

$$3Nb_2O_5+11.14TiO_2+24.86Al \quad 6Nb+11.14Ti+12.43Al_2O_3$$

Generally, unless a post formation EB melting is used, slightly less than stoichiometric aluminum is preferred.

The above alloy is convenient, as it is relatively low melting and less expensive than more niobium rich alloys; however, the process can be used to produce any niobium-titanium superconductor composition.

In the past, the reducing of $Nb_2O_5$ has been done with excess aluminum and a fluxing agent (such as barium oxide) to produce niobium metal and a resulting $Al_2O_3$/BaO slag. This then required separation of the niobium metal (from the slag) and purification thereof, generally by electron beam melting (as the melting point of niobium metal is about 2468° C. good separation between the metal and slag was generally not obtained and the excess aluminum metal was separated from the niobium metal during EB melting). Simulator results and operating experience have shown that temperature of about 2800°-3380° C. can be obtained in the prior art reaction (the simulator results used a preignition temperature of about 200° C. and the higher end of the temperature range was achieved by better insulation factors). The purified niobium metal was then powdered and mixed with titanium powder. This was in turn followed by melting of the mixture to produce ingots of the desired alloy.

In our invention, titanium in the form of titanium metal powder and/or titanium dioxide powder is added to niobium pentoxide powder and aluminum powder before ignition of the mixture. Generally, aluminum is included in an amount approximately equal to 0.8-1.1 of that required to react with all of the oxygen in the mixture, such that at least most of the oxygen is reacted with aluminum to form aluminum oxide. Titanium can be added typically on the basis of 33.3% by weight to 49.8% by weight of the $Nb_2O_5$, and 16.9% by weight of aluminum. Such a mixture reacts to directly produce the approximately 49 mole percent Ti niobium-titanium superconductor alloy, having a melting point between 2000° and 2200° C., and an $Al_2O_3$ (and possibly $TiO_2$) slag which is easily separated from the molten alloy. The molten alloy product contains very little, if any, aluminum and can generally be cast directly into ingot form for marketing and subsequent utilization.

If further purification of the alloy produced by this invention is necessary for a particular instance of use, it may be subjected to electron beam melting. However, since some of the titanium content is lost during such melting procedure, the titanium content of the alloy should be increased to compensate for the loss, as will be apparent to and within the skill of those skilled in the art. Note that alloys with higher titanium are lower melting, and are thus more easily produced. Note also that the electron beam melting will remove aluminum and thus, when Al is used in excess of stoichiometric, the alloy is generally electron beam melted.

The following examples are of simulator results (with the same preheating and again with the higher end of the temperature range being achieved by better insulation). In the first two examples, aluminum is included in a stoichiometric amount to react with all of the oxygen. In the middle two examples, aluminum is included in excess of the amount required to react with all of the oxygen in the mixture to form aluminum oxide, thus producing an essentially titanium-dioxide-free slag and a metallic product containing aluminum, and thus the metallic product is to then be melted in an electron beam furnace. In the last two examples, aluminum is included in an amount less than required to react with all of the oxygen in the mixture to form aluminum oxide, thus producing an essentially titanium-dioxide-containing slag and a metallic product essentially free of aluminum.

EXAMPLE I

The relative proportions of the constituents of the titanium/aluminum/niobium pentoxide in the mixture were approximately by moles, 11.14 Ti/10 Al/3 $Nb_2O_5$. This gave temperatures of about 1760°-2180° C. above the preignition temperature, thus good insulation and/or some other source of heat (such as more preheating) is needed. Thus with normal alumina powder insulation, additional preheating of at least 240° C. would give the at least 2000° C. to liquify the mixture. Note, however, that both temperatures achieved and temperatures desired vary with both reaction configuration and reaction composition.

EXAMPLE II

The relative proportions of the constituents of titanium dioxide/aluminum/niobium pentoxide in the mixture were approximately by mole, 11.14 $TiO_2$/24.86 Al/3 $Nb_2O_5$. This gave temperatures of about 2060°-2320° C. above the preignition temperature, thus with reasonable insulation, additional heat is generally not required.

EXAMPLE III

The relative proportions of the constituents of the titanium/aluminum/niobium pentoxide in the mixture were approximately by moles, 11.14 Ti/11 Al/3 $Nb_2O_5$. This gave temperatures of about 1720°-2120° C. above the preignition temperature, thus, either good insulation, or some other source of heat (such as more preheating) is generally needed.

EXAMPLE IV

The relative proportions of the constituents of titanium dioxide/aluminum/niobium pentoxide in the mixture were approximately by mole, 11.14 $TiO_2$/25.86

Al/3 $Nb_2O_5$. This gave temperatures of about 2025°-2310° C. above the preignition temperature, thus extra insulation and/or some additional source of heat is generally not needed (but, in this as well as other examples, preheating to get temperatures above about 2470° C. can still be used, however, especially when EB melting is not used, to get a more homogeneous product and better slag separation).

EXAMPLE V

The relative proportions of the constituents of the titanium/aluminum/niobium pentoxide in the mixture were approximately by moles, 11.29 Ti/9.8 Al/3 $Nb_2O_5$. This gave temperatures of about 1730°-2150° C. above the preignition temperature, thus good insulation and/or some additional source of heat is needed.

EXAMPLE VI

The relative proportions of the constituents of titanium dioxide/aluminum/niobium pentoxide in the mixture were approximately by mole, 11.44 $TiO_2$/24.85 Al/3 $Nb_2O_5$. This gave temperatures of about 2020°-2280° C. above the preignition temperature, thus extra insulation and/or some additional source of heat is generally not needed. This type of mix (using titanium dioxide, rather than titanium, and a slight excess of titanium oxide to give some titanium dioxide in the slag and assure that there is essentially no aluminum metal in the product) is preferred, especially when EB melting of the reaction formed alloy is not used.

Note that when titanium metal is used, less aluminum than necessary to reduce all of the $Nb_2O_5$ can be employed so long as the combined amount of Al and Ti is sufficient to reduce all of the $Nb_2O_5$ and provided that there is sufficient heating to raise the total energy balance up to the point at which the alloy will form (a powerful oxidizer can be added in effective quantity for the purpose). These are commonly used in the production of ferroniobium. Those skilled in the art can carry out either of these alternative procedures.

It should be noted that this process eliminates the need to powder the niobium (possibly also the need to use powdered titanium). Further, the maximum temperature which the alloy of the invention must reach can be lower than the temperature which the metal of the prior art required during alloying. As a result, this process can minimize phase segregation during cooling and can provide a more homogeneous product.

Whereas this invention is here illustrated and described with specific reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

We claim as our invention:

1. A process for the direct production of a superconductive niobium-titanium alloy during reduction of niobium pentoxide, comprising mixing at least one of titanium metal powder and titanium dioxide powder with niobium pentoxide powder and aluminum powder; heating the resulting mixture to form a niobium-titanium alloy and a slag consisting essentially of aluminum oxide; and separating said alloy and said slag.

2. A process according to claim 1, wherein aluminum is included in an amount approximately equal to that required to react with all of the oxygen in mixture to form aluminum oxide.

3. A process according to claim 1, wherein aluminum is included in an amount approximately equal to 0.8-1.1 of that required to react with all of the oxygen in the mixture to form aluminum oxide.

4. A process according to claim 1, wherein aluminum is included in excess of the amount required to react with all of the oxygen in the mixture to form aluminum oxide, thus producing an essentially titanium-dioxide-free slag and a metallic product containing aluminum, and wherein said metallic product is then melted in an electron beam furnace.

5. A process according to claim 1, wherein aluminum is included in an amount less than required to react with all of the oxygen in the mixture to form aluminum oxide, thus producing a titanium-dioxide-containing, aluminum oxide slag and a metallic product essentially free of aluminum.

6. A process according to claim 1, wherein oxidizing is effected by the inclusion of sufficient aluminum powder to provide for a thermite reaction, and by igniting the resulting mixture.

7. A process according to claim 1, wherein oxidizing is effected by preheating the mixture to a sufficient extent to raise the total energy balance up to the proper point for the alloy to form.

8. A process according to claim 1, wherein oxidizing of the mixture is effected by including in the mixture an effective quantity of an oxidizer.

9. A process according to claim 2, wherein the relative proportions of the constituents of the titanium-/aluminum/niobium pentoxide in the mixture are approximately by moles, 11.14 Ti/10 Al/3 $Nb_2O_5$.

10. A process according to claim 2, wherein the relative proportions of the constituents of titanium dioxide/aluminum/niobium pentoxide in the mixture are approximately by mole, 11.14 TiO2/24.86 Al/3 $Nb_2O_5$.

11. A process according to claim 4, wherein the relative proportions of the constituents of the titanium-/aluminum/niobium pentoxide in the mixture are approximately by moles, 11.14 Ti/11 Al/3 $Nb_2O_5$.

12. A process according to claim 4, wherein the relative proportions of the constituents of titanium dioxide/aluminum/niobium pentoxide in the mixture are approximately by mole, 11.14 TiO2/25.86 Al/3 $Nb_2O_5$.

13. A process according to claim 5, wherein the relative proportions of the constituents of the titanium-/aluminum/niobium pentoxide in the mixture are approximately by moles, 11.29 Ti/9.8 Al/3 $Nb_2O_5$.

14. A process according to claim 5, wherein the relative proportions of the constituents of titanium dioxide/aluminum/niobium pentoxide in the mixture are approximately by mole, 11.44 $TiO_2$/24.86 Al/3 $Nb_2O_5$.

15. A process according to claim 1, wherein the alloy and slag are separated, and said alloy metal is cast into ingots.

16. A process for the direct production of a superconductive niobium titanium alloy during reduction of niobium pentoxide, comprising adding about 33.3 weight percent of titanium dioxide powder to a mixture of about 16.9 weight percent of aluminum powder and about 49.8 weight percent niobium pentoxide powder; heating the resulting mixture to form a niobium titanium superconductive alloy and an essentially aluminum oxide slag; and separating said alloy and said slag.

* * * * *